US005495738A

United States Patent [19]

Gottschalk

[11] Patent Number: 5,495,738

[45] Date of Patent: Mar. 5, 1996

[54] METAL ROLLING MACHINE WITH OPPOSING BANKS OF JAW UNITS FOR WORKING A CENTERED WORKPIECE AND METHOD OF ROLLING ANNULAR FILLETS OF WORKPIECES

[75] Inventor: William P. Gottschalk, Davisburg, Mich.

[73] Assignee: Hegenscheidt Corporation, Troy, Mich.

[21] Appl. No.: 242,262

[22] Filed: May 13, 1994

[51] Int. Cl.[6] ..... B21H 7/00

[52] U.S. Cl. ..... 72/110; 72/107

[58] Field of Search ..... 72/107, 109, 110; 29/6.01

[56] References Cited

U.S. PATENT DOCUMENTS 4,561,276 12/1985 Berstein ..... 72/110

4,870,845 10/1989 Nakagawa ..... 72/110

5,138,859 8/1992 Winkens ..... 72/110

*Primary Examiner*—Lowell A. Larson

*Attorney, Agent, or Firm*—Reising, Ethington, Barnard & Perry

[57] ABSTRACT

Machine and method for deep rolling annular fillets of journals of metallic workpieces, such as the crank pins of an engine crankshaft in which the crankshaft is loaded into a center positioned turning lathe, and left and right hand banks of floating jaw units located on opposite sides of the lathe are moved from a first station in which crankshafts can be loaded on or unloaded from the lathe to a second station in which inboard jaw ends of the jaw units with fillet rolling tools aboard are operatively engaged under load with each of the pin fillets, which are then simultaneously rolled as the lathe motor turns the crankshaft about its rotational axis and the tooling carried by the floating jaw units orbits the axis and completely deep rolls the fillets.

9 Claims, 7 Drawing Sheets

FIG-2
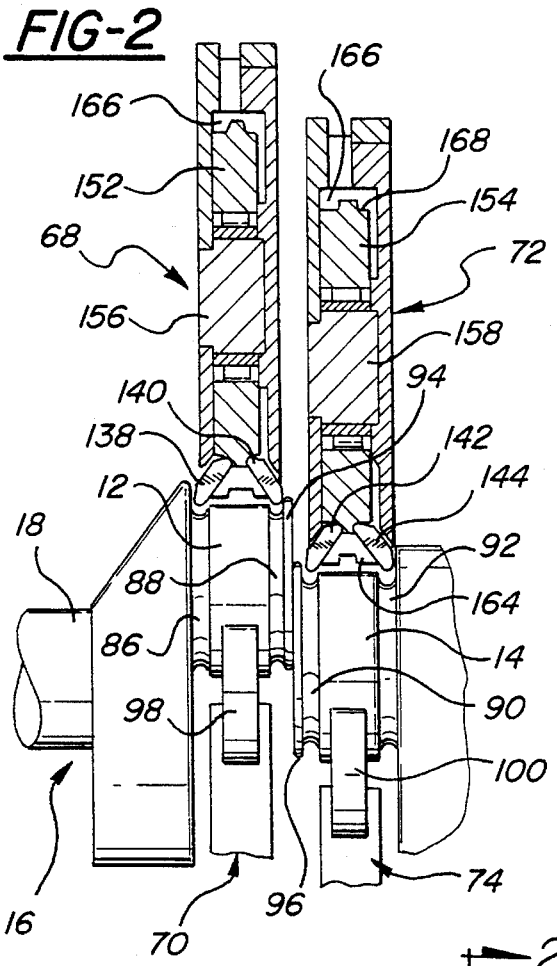
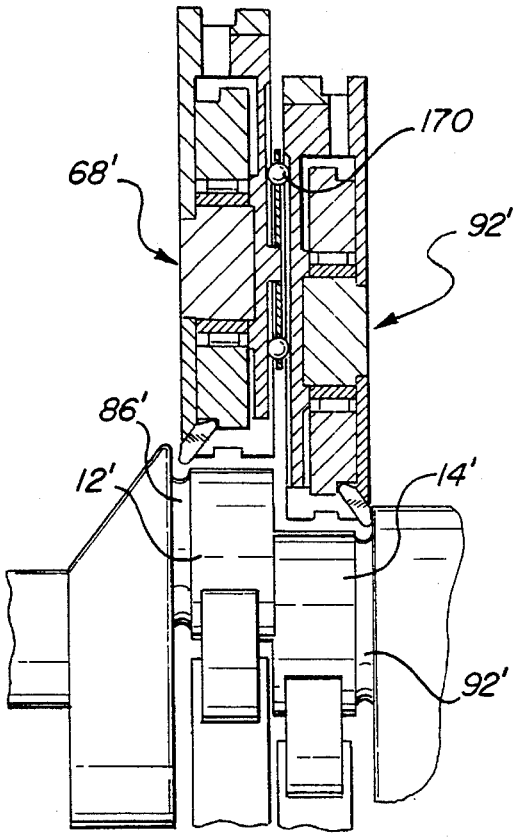
FIG-3
FIG-4
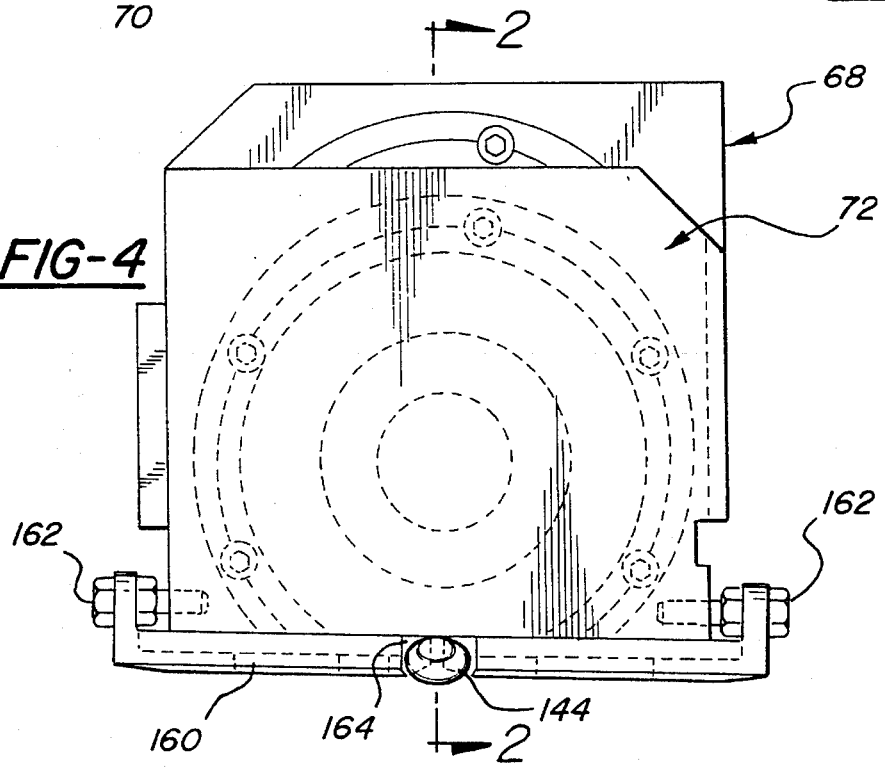

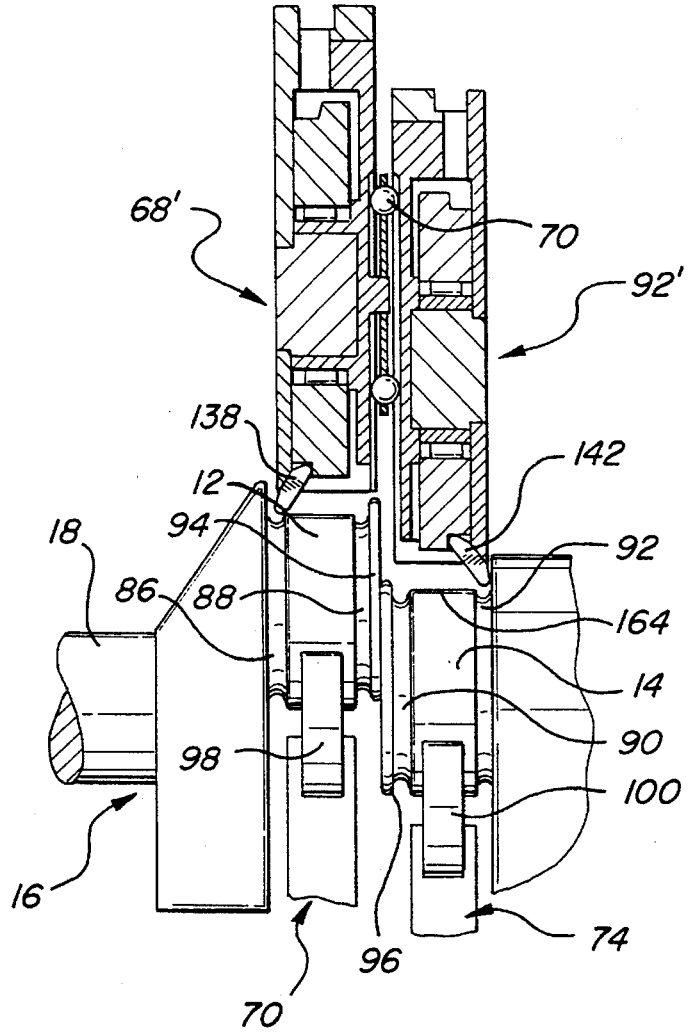
FIG-3A
FIG-3B
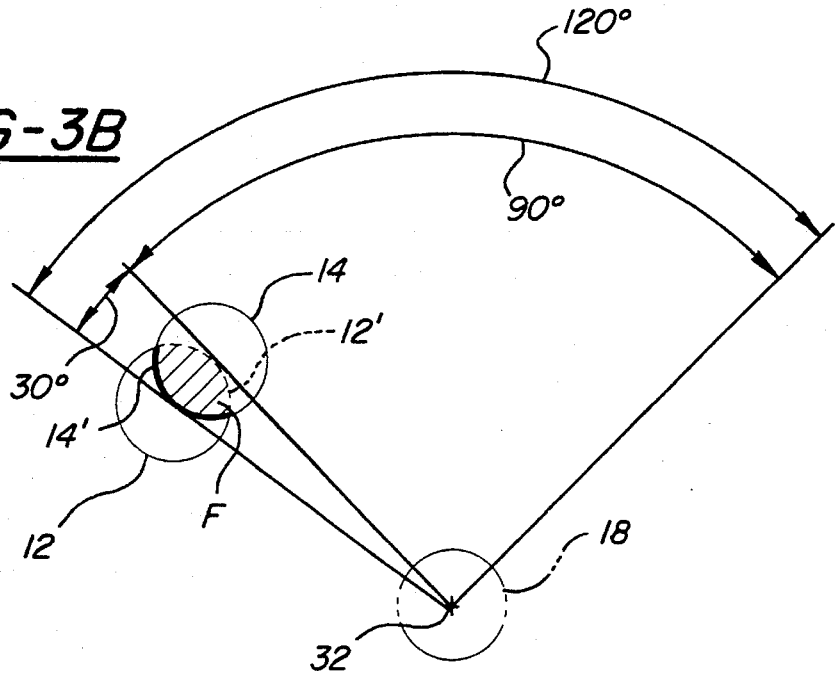

METAL ROLLING MACHINE WITH OPPOSING BANKS OF JAW UNITS FOR WORKING A CENTERED WORKPIECE AND METHOD OF ROLLING ANNULAR FILLETS OF WORKPIECES

FIELD OF THE INVENTION

This invention relates to metal working, and more particularly, to new and improved machinery for rolling the fillets of metal workpieces and to new and improved methods for simultaneously rolling all or a number of fillets of workpieces such as fillets of crank pins of an engine crankshaft.

DESCRIPTION OF RELATED ART

Prior to the present invention, various machines and methods have been employed to strengthen and finish metal workpieces such as the camshafts and crankshafts for internal combustion engines. As many engines have been downsized for installation in smaller vehicles, difficulties have occurred in finishing and strengthening correspondingly downsized workpieces. For example, the crank pins of downsized crankshafts are particularly difficult to strengthen by fillet rolling with optimized efficiency since the lengths of the crank pins are so small that there is insufficient space for tooling to simultaneously roll all of the fillets in a single rolling operation.

Prior to the present invention, such crank pins and main bearings for downsized crankshafts as well as crankshafts for larger engines have been strengthened by various fillet rolling machines and methods. For example, in U.S. Pat. No. 5,138,859 to Winkens, issued Aug. 18, 1992, for "Method and Apparatus for Smooth-Rolling and Deep-Rolling Multi-Stroke Crankshafts", a machine unit and method for rolling the pin fillets of crankshaft is disclosed to solve space problems that preclude the simultaneous rolling of neighboring crank pins with available equipment. In that patent disclosure, a first relative position of the machine unit and crankshaft is established so that the fillets of a first set of non-neighboring pins are deep rolled. Subsequently, in a second relative position of the machine unit and crankshaft, the fillet of a second set of non-neighboring pins is deep rolled. With such construction and method, all of the fillets are rolled in two stages or two steps by a single machine.

While such machines and methods are effective and produce high quality work, new and improved machines and methods are needed to meet higher standards for machine operating efficiency with high volume output and long service life while producing superior parts such as high quality crankshafts with fillets strengthened by deep rolling.

Application U.S. Ser. No. 176,792, filed Jan. 3, 1994, now U.S. Pat. No. 5,445,003 assigned to the assignee of this invention is hereby incorporated by reference. That application and patent sets forth equipment, tooling and methods for rolling the fillets of workpieces in which fillet rolling jaw arms are stationed in staggered sets to one side of a crankshaft so that all of the pin fillets of a crankshaft can be deep rolled in one rolling operation.

Applicant's Disclosure Document No. 353030, dated Apr. 22, 1994, disclosing aspects of this invention is hereby incorporated by reference.

The present invention is directed to machinery and tooling and methods akin to those disclosed in the above cited U.S. Pat. No. 5,445,003, but further advances the art by providing other new and improved methods, rolling equipment and tooling which are suitable for a wide range of applications, particularly, those in which simultaneous rolling of fillets from opposing sides of the workpiece or crankshaft is necessary or desired.

Importantly, the present invention solves space problems encountered in many installations in which floating tools are needed to roll closely adjacent or neighboring fillets that impedes or even precludes the use of bulky, side-by-side rolling equipment currently available.

One preferred embodiment of the machine of this invention has opposing banks of fillet rolling jaw units which are capable of simultaneously deep rolling all of the fillets of crank pin journals including neighboring pin journals as well as the main bearing journals of a crankshaft.

In this invention, opposing banks of fillet rolling jaw units can be simultaneously moved toward and away from one another between (1) an open position so that unfinished workpieces, such as crankshafts, can be loaded into the turning lathe or finished workpieces can be unloaded from the lathe, and (2) a closed position in which fillet rolling tools engage all or a number of crank pin fillets including fillets of neighboring-crank pins, as well as main bearings, so that they can be simultaneously deep rolled and strengthened.

This invention further is drawn to methods of simultaneously rolling the fillets of workpieces such as the pin journals of an elongated internal combustion engine crankshaft comprising the steps of: (a) mounting one end of the crankshaft in the headstock of a motor driven turning machine and the other end in a support in the machine so that the crankshaft can be driven by the machine about its axis of rotation, (b) positioning left and right side banks of fillet rolling devices on the left and right sides respectively of an axis of rotation so that jaw arms of the devices extend generally transverse to the axis allowing an unworked crankshaft to be loaded into the turning machine, (c) moving the left and right side banks of devices from an initial position spaced from the crankshaft to a position in which fillet rolling tooling carried on the jaw arms contact the fillets of the pin journals, (d) applying a load to the pin journals through the jaw arms and the tooling, (e) powering the turning machine to rotate the crankshaft about the axis while the tooling compressively loads the fillets so that the tooling simultaneously works and deep rolls the fillets of the pin and main journals, (f) opening the jaw arms and removing the rolled crankshaft from said machine.

The present inventions is illustrated in the following detail description and drawing in which:

BRIEF DESCRIPTION OF THE DRAWINGS

FIG. 2 is a sectional view, with some parts in full lines, taken generally along sight lines 2—2 of FIG. 1 showing fillet rolling tools rolling the fillets of neighboring crank pins separated by fences of a crankshaft;

FIG. 3 is a view similar to the view of FIG. 2 illustrating another embodiment of rolling tools, rolling fillets of adjacent crank pin journals that are not fenced;

FIG. 3A is a view similar to the views of FIG. 2 and 3 illustrating the tool of FIG. 3 utilized to roll fenced crank pins of the crank of FIG. 2;

FIG. 3B is a diagram illustrating the overlapped crank pins of FIG. 3B;

FIG. 4 is a diagrammatic side elevational view of the tooling of FIG. 2 taken generally along sight lines 4—4 of FIG. 2;

DETAILED DESCRIPTION OF THE DRAWINGS

Figure 1:
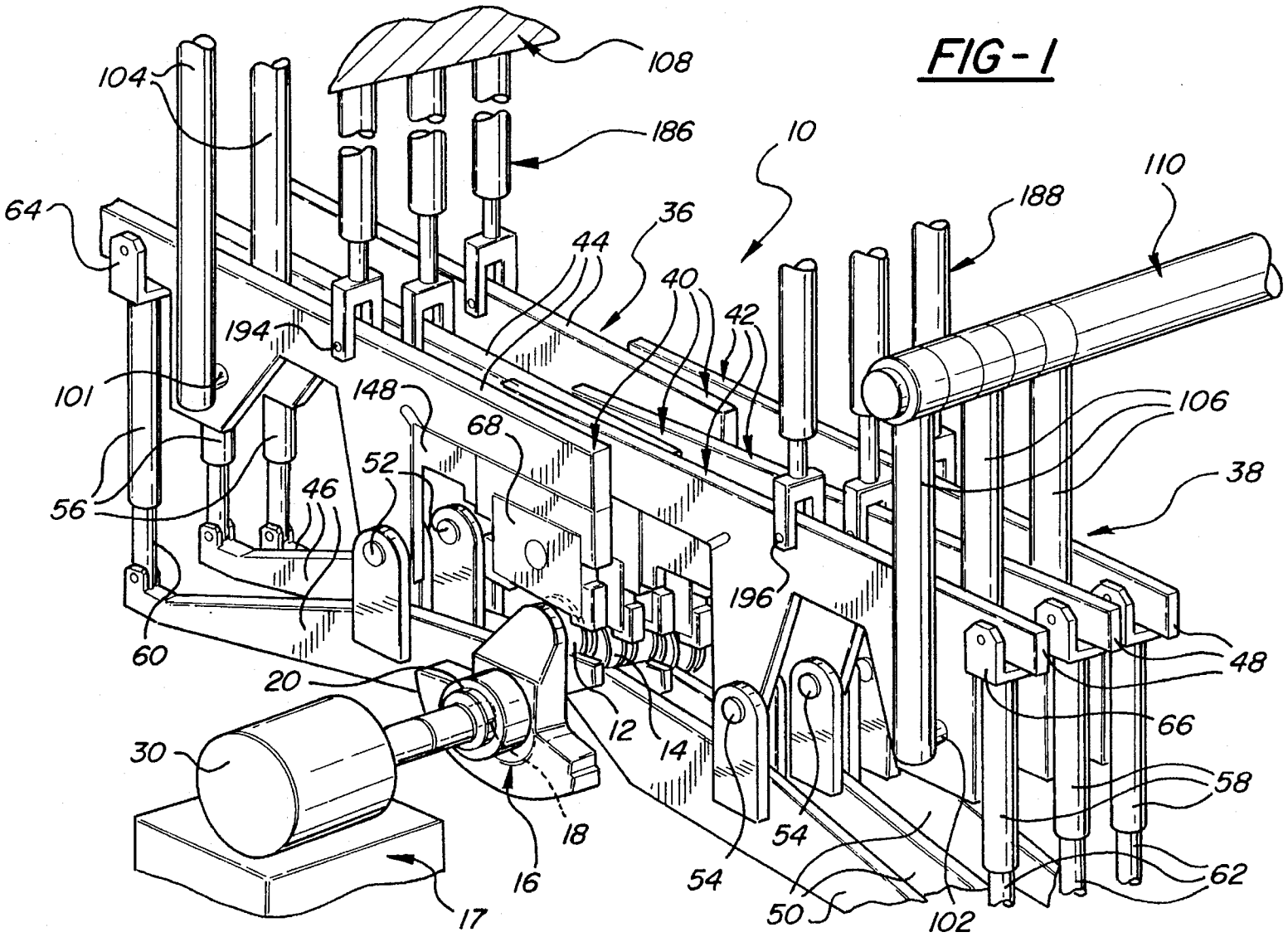
FIG. 1 is a pictorial view illustrating the principals of a preferred embodiment of a fillet rolling machine and method of the present invention.

Turning now in greater detail to the drawings, FIG. 1 pictorially illustrates part of a machine 10 for rolling the fillets of the journals of a workpiece here illustrated as the split or arcuately offset and neighboring crank pins 12, 14 of an elongated crankshaft 16 for an internal combustion engine.

The crankshaft 16 is loaded into a workpiece turning lathe 17, or other mechanism, with the nose end or the flange end 18 of the crankshaft mounted in the chuck of headstock 20 and the opposite end mounted on a shaft center 24 of the lathe tailstock. The headstock is selectively rotated by a motor 30 so that the crankshaft 16 will be turned on its rotational axis 32.

The fillet rolling machine 10 has left and right side banks 36, 38 each having a plurality of floating jaw units 40, 42 respectively. Each floating jaw unit is comprised of upper and lower jaw arms 44, 46 (left hand bank of jaw units 40) and 48, 50 (right hand bank jaw of units 42) pivotally interconnected between the inboard and outboard ends thereof by pivots 52, 54. The outboard ends of each pair of arms are operatively interconnected by selectively expansible and contractible pneumatic or hydraulic power cylinders 56, 58 or other suitable controlling actuator units which under expansion force pressure loads the fillet working rollers for rolling the fillets of the crank pins. Each power cylinder has a piston with a rod 60 or 62 pivotally connected to a lower arm while the associated cylinder tube thereof terminates in a clevis 64 or 66 which is pivotally connected to an associated upper jaw arm 44 or 48.

The inboard ends of the upper and lower arms of each jaw unit directly oppose one another and are fixtured with upper and lower tools 68, 70 or 72, 74, (FIG. 2) to deep roll annular fillets 86, 88 and 90, 92 in the arcuately offset and neighboring crank pins 12, 14 of the crankshaft 16 which are separated by annular gates or fences 94, 96. The lower tools 70, 74 respectively secured to the lower arms of the left and right hand side jaw units have pairs of spaced back-up rollers 98, 100, respectively, to engage and support the pin journals as their fillets are being rolled. Such lower back-up tools are disclosed in greater detail in U.S. Pat. No. 5,445,003, referenced above.

Each floating jaw unit 40 of the left bank 36 and floating jaw unit 42 of the right bank is respectively pivotally supported by pivot 101, 102 to an associated upper swing arm 104, 106. As shown, these arms further are pivoted by pivots 105, 107 to and depend from left and right hand side movable upper frames 108, 110 that are mounted on linear slide mechanisms or carriages 112, 114 (FIGS. 5 and 6) that ride along front and rear horizontal support rails 116, 118. The rails 116, 118 are respectively fixed to support beams 120 supported by uprights 122 fixed to a floor or base 124. Actuators such as hydraulic power cylinders 126, 128 are operatively connected to the left and right hand upper frames 108 and 110 respectively and are selectively employed to move the frames and associated banks of floating jaw units operatively connected thereto between a retracted position (FIG. 5) for workpiece part unloading and loading and a closed position (FIGS. 6 and 7) for deep fillet rolling operations. Accordingly, after the crankshaft 16 has been loaded into the jaws of the jaw units, each bank can be selectively engaged with the journals so that the rollers 138, 140 of tool 68 and rollers 142, 144 of tool 72 engage the fillets under predetermined load which may be selectively varied as provided by selectively varying the expansion force exerted by cylinders 56, 58.

The drive motor 30 connected to the chuck of headstock 20 is selectively operative to rotatably drive the crankshaft 16 around axis 32. The pairs of clamping jaws being mounted for "floating operation" by swing arms 104, 106 pivotally mounted to upper support structures provided by frames 108, 110. When the motor turns the crankshaft for deep rolling operation, the arms oscillate in an arcuate path and the separate pairs of jaws follow the orbit of the radially offset crank pins circling axis 32 to deep roll and work the fillets of these crank pins. Rolling pressure is established by the expansion force in the cylinders 56, 58. As known in this art, such deep rolling of annular fillets works the metallic substrate of the fillets to strengthen the fillets and the crankshaft.

Each of the upper tools 68 and 72, respectively carried by upper arms 44, 46 of the left and right hand side jaw units comprises a housing which is releasably secured to the upper jaw of each arms by attachment units 148, 150. Each housing has a back-up roller 152, 154 mounted on needle bearings that are supported on centralized hub 156, 158 which are secured between the housing side plates.

The hardened fillet rollers, such as rollers 138, 140, are adjustably mounted for rotation about oppositely inclines axes A, A' on the lower side of the tools by cages, such as cage 160, and opposing adjustable threaded fasteners 162. The cages have pockets 164 formed therein in which the rollers of hardened steel or other suitable materials are operatively mounted. These fillet rollers contact associated annular tracks 166, 168 in the back-up roller so that localized rolling loads can be applied to the fillets by the jaw arms. When the crankshaft is turned by the operation of the lathe motor, the rollers contact the facing pairs of fillets 86, 88 and 90, 92 of the neighboring pins of the crankshaft so that the fillets are pressure rolled and deep worked when the crankshaft is turned.

The lateral side loads resulting from rolling operation with the FIG. 2 tooling are cancelled because the rollers 138, 140 and rollers 142, 144 in each of the tools have equal and opposite inclinations. However, in the event that the crankshaft has no fence between the arcuately offset pins 12', 14' such as shown in FIG. 3, and only fillets 86' and 92' are rolled. A caged ball bearing unit 170 interposed between the housing of tools 68', 72' allows opposing side loads resulting from deep rolling of the neighboring pin fillets 86' and 91' to cancel as explained in application Ser. No. 176,792. To accommodate movement of the tools, the bearing unit 170 is carried by one of tools and will engage with the side of the other tool so that the side loads from rolling the neighboring and opposing fillets will cancel.

The diagram of FIG. 3B illustrates the overlap (shaded connecting area F) occurring between the adjacent and arcuately offset crank pins 12 and 14 and at the inboard fenced fillets 88 and 90.

For improved roll strengthening of this construction without undue bending or displacement of the fences, such as fences 94 and 96, the fillets 86, 88 and 90, 92 are first rolled with the FIG. 2 tooling preferably with variable pressure rolling so that the arc 12' (dashed line) and 14' (full darkened line) of the overlap are rolled at high pressure for deep working and strengthening in the inboard fillets 88 and 90 in these areas. The remaining arcuate portions of the inboard fillets are rolled at a lower pressure sufficient to maintain integrity of the fences 94, 96. Accordingly, there is no bend-over of the fences at any point. Subsequently, the outboard fillets 86 and 92 are deep rolled with the tooling shown in FIG. 3A with constant or variable pressure so that the outboard fillets 86 and 92 are fully deep rolled and strengthened. This procedure may be reversed with the outboard fillets deep rolled and strengthened with FIG. 3A and then the inboard fillets 86 and 90 rolled with variable pressures as stated.

Figure 5:
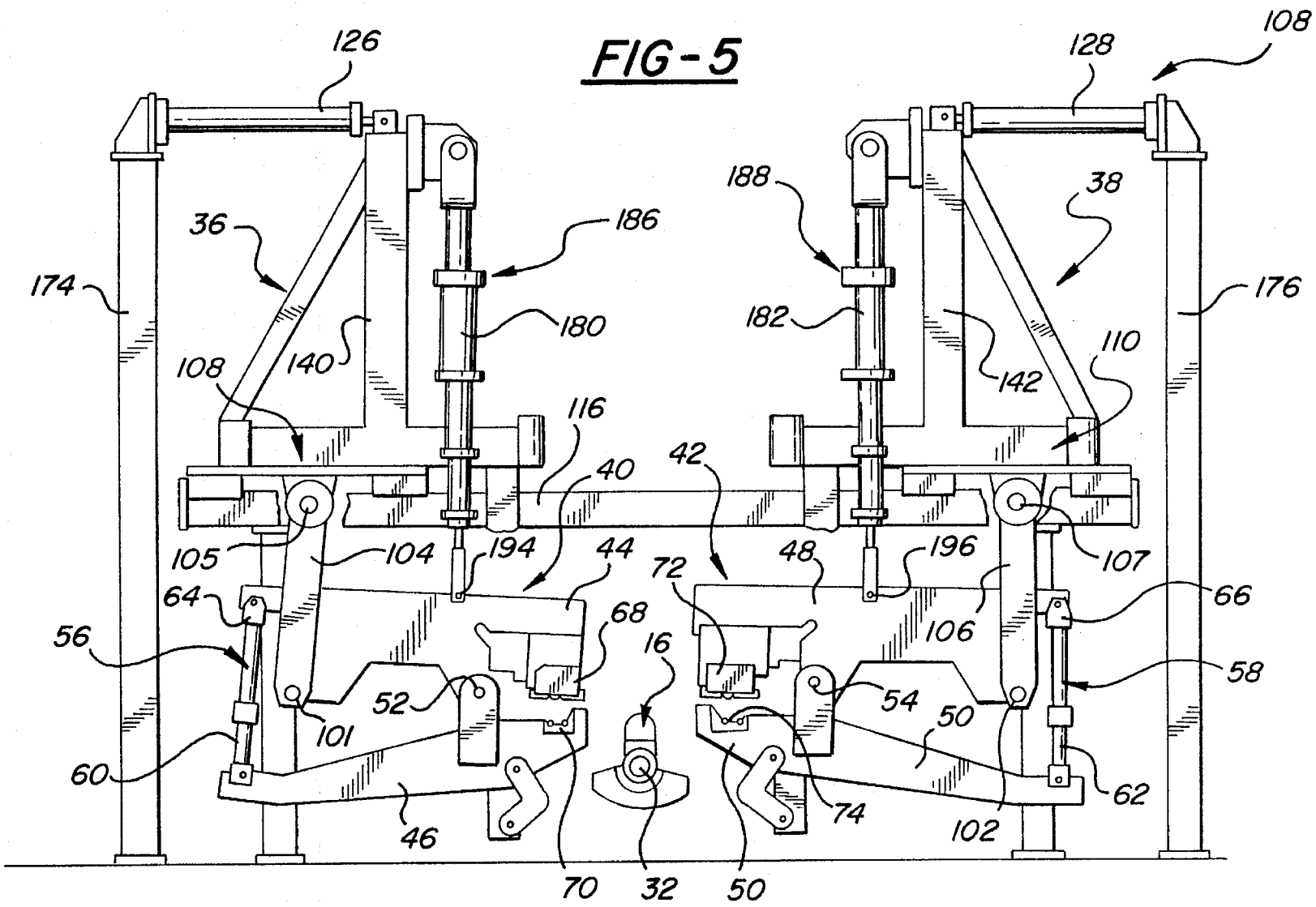
FIG. 5 is a diagrammatic front elevational view of the machine of one preferred embodiment of the fillet rolling machine of this invention showing the banks of the machine in a retracted position for workpiece loading or unloading.
Figure 6:
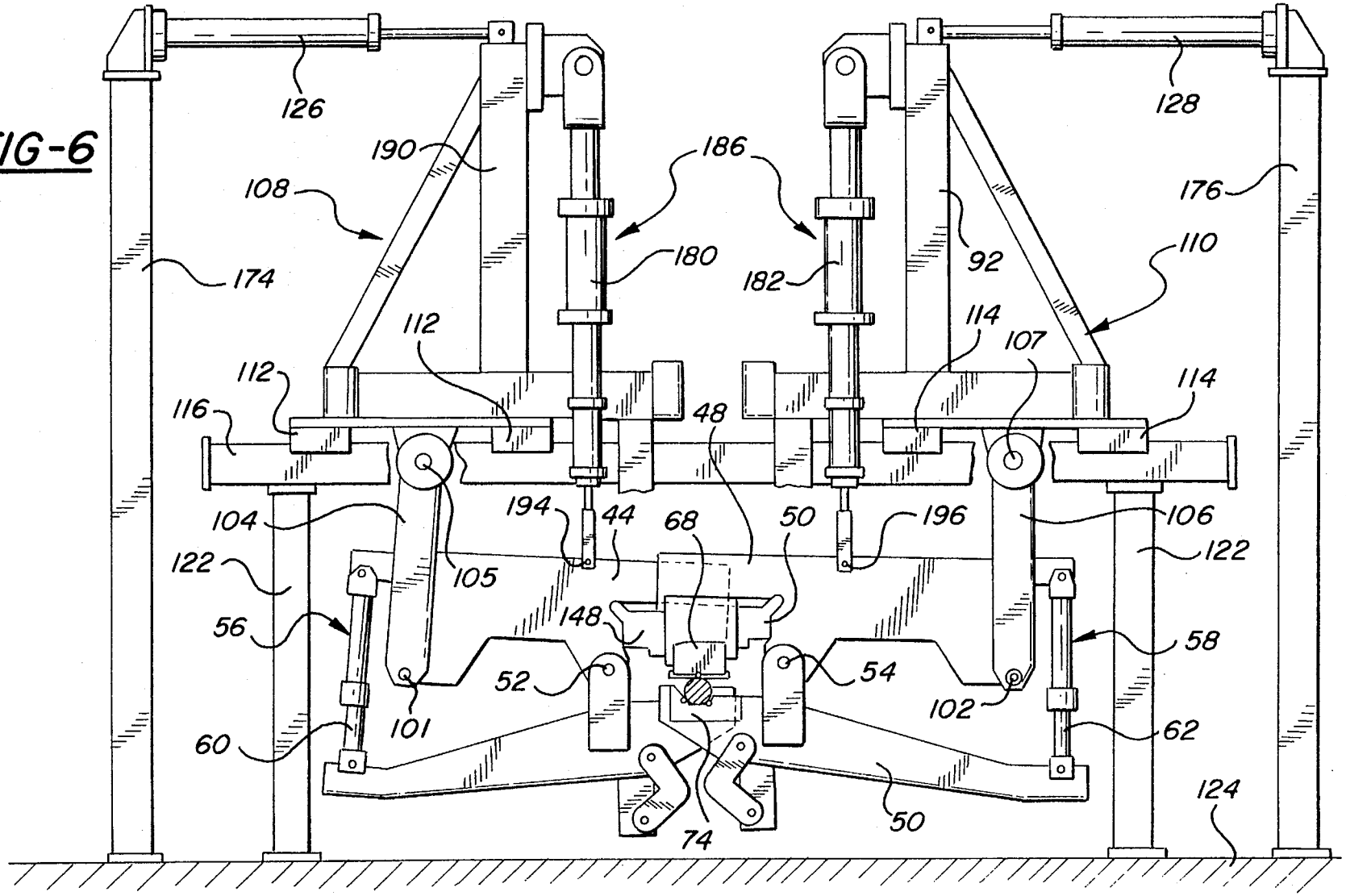
FIG. 6 is a view similar to the view of FIG. 5 but with the banks moved inwardly from the FIG. 5 position to a working position in which the fillet rolling tools engage fillets of the crankshaft.

Turning now to FIG. 5, the machine is shown diagrammatically in front view with the crankshaft 16 with radially offset pins mounted in the centrally located lathe and the banks 36, 38 of jaw units are moved away from each other and the crankshaft by operation of the power cylinders 126, 128 which have their cylinder tubes attached to uprights 174, 176 that are fixed at their lower ends base 124.

Central tool lift sections 180, 182 of control and counter-balance cylinders 184, 186, have clevises at their upper ends pivoted to ears extending from the upper ends of uprights 190, 192 of the upper frames of the left and right hand side banks of jaw units. The lift sections have their lower ends pivoted at 194, 196 to the upper jaws 44 and 48. The lift sections may be selectively actuated to effect the opening of the jaws of the jaw units so the crankshaft mounted in the centrally located lathe 16 can be loaded into the banks of the jaw units when the banks are moved to the FIG. 6 rolling position. The jaws of the units are subsequently closed by expanding the cylinders 56, 58 while the tool lift sections 180, 182 of the control and counter-balance units are deactivated. The crank pins are accordingly gripped by the tools with a low but sufficient force to hold the crankshaft from turning.

Subsequent actual fillet rolling is started by rotation of the crankshaft by motor 30 and the force on the fillets by the rollers is increased to deep rolling force by increasing the force exerted by the cylinders 56, 58 to the respective jaw units. The rolling pressure may be varied during rolling as the crankshaft is rotatably driven until the fillet rolling is completed. The jaws and tooling follow the circular paths of the associated pins being rolled and the affiliated swing arms oscillate or swing back and forth through an arc to allow floating movement. The control and counter-balance cylinders 186, 188 pivotally secured between the upper support structure and the upper jaw arms may have a stroke change section 196 so that different crankshafts with different crank pin locations can be rolled. Cylinders 186, 188 additionally have pneumatic spring counter-balance sections 200. The spring section is like a gas spring and is operative for the smooth movement of the jaw units arms when the fillets are being rolling.

Figure 7:
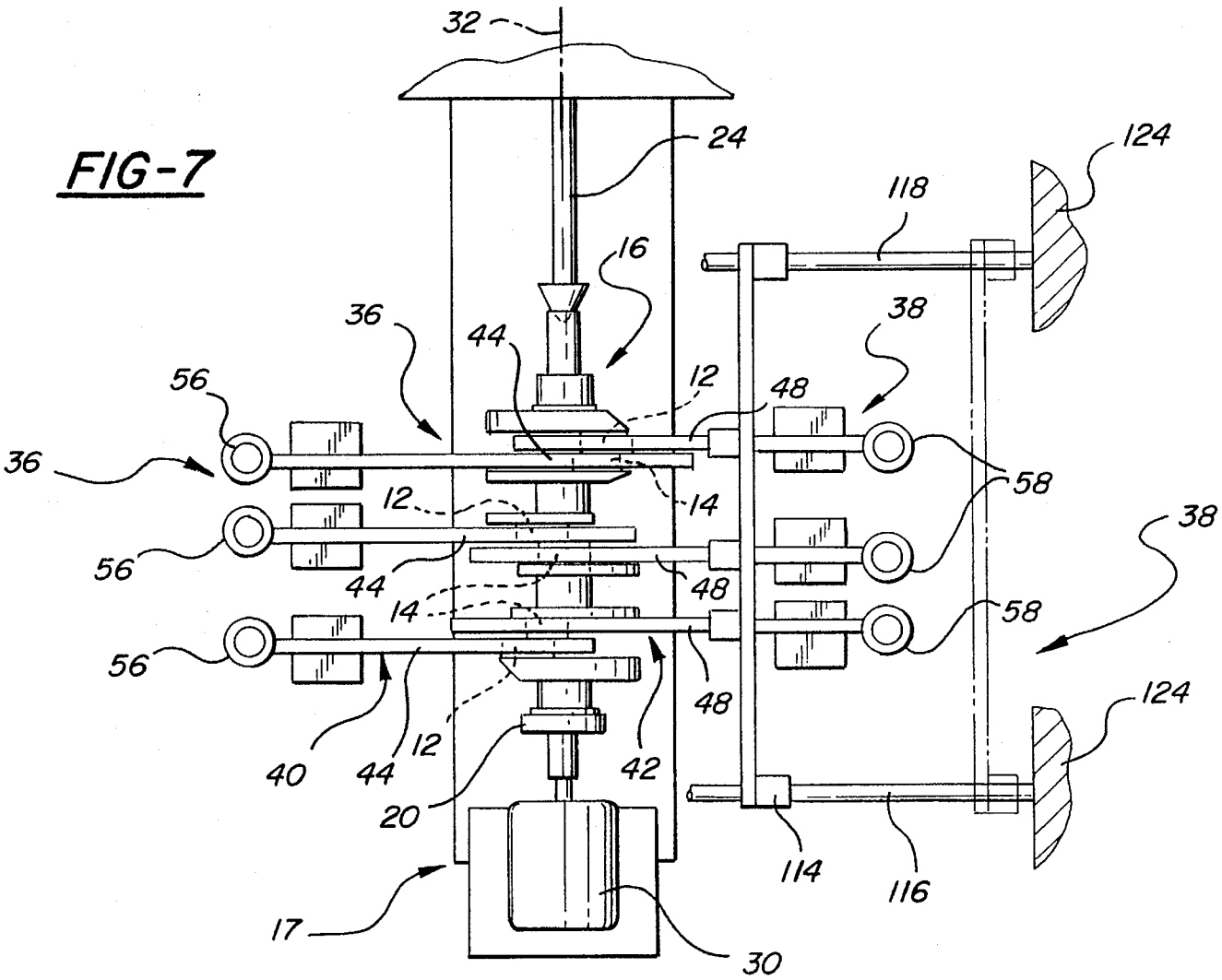
FIG. 7 is a diagrammatic top view of a portion of the machine of FIG. 6.
Figure 8:
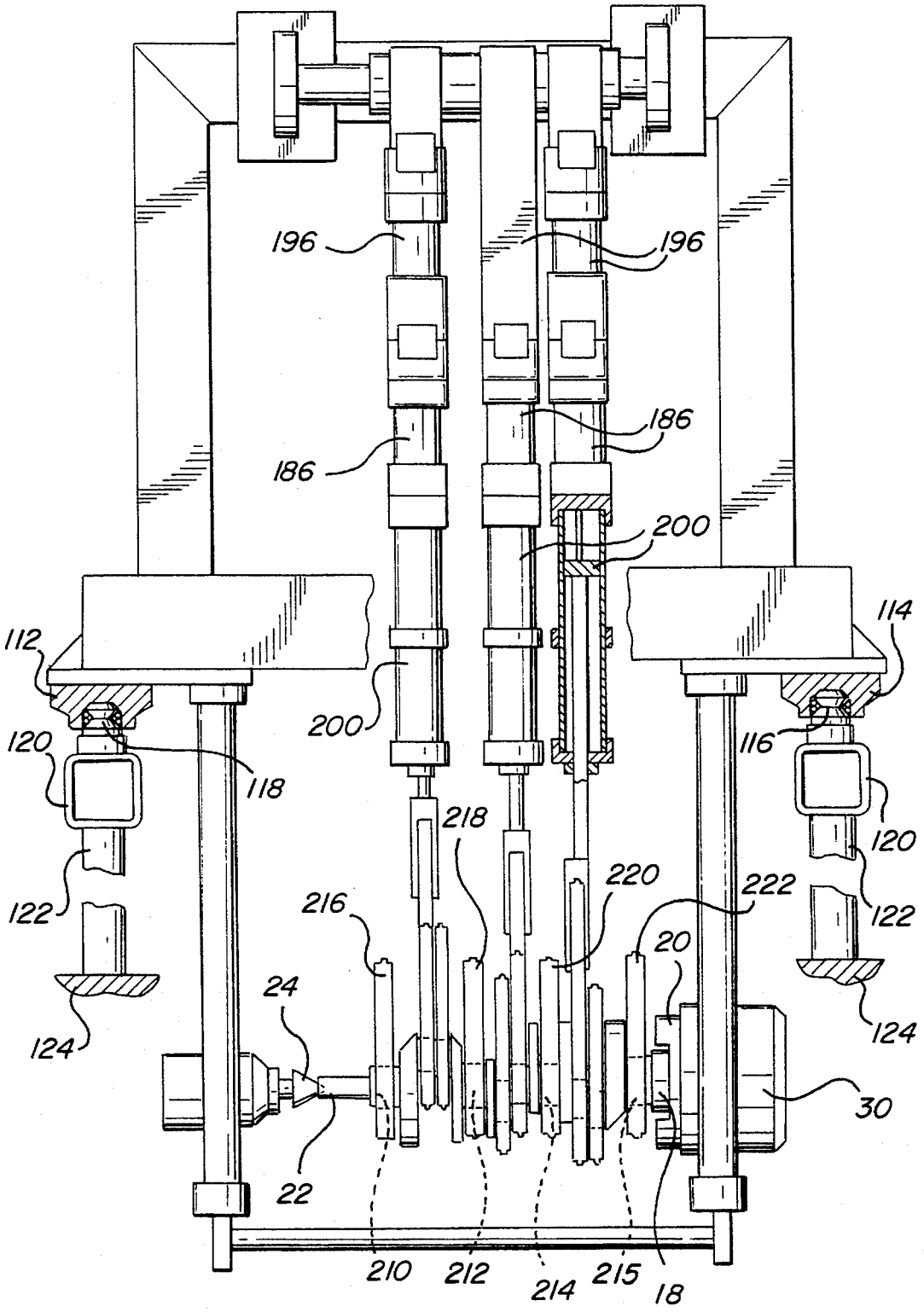
FIG. 8 is a diagrammatic side elevational view of part of the fillet rolling machine of FIGS. 5 and 6 taken generally along sight lines 8—8 of FIG. 6.

FIG. 7 is an upper view of the left and right hand banks of pivot arms which roll the offset crank pins shown in phantom, lines in the drawing. With this arrangement, it will be appreciate that the cylinders required to provide rolling pressure to the jaw units can be easily employed in the machine since the cylinders and jaw nits for neighboring pins are operatively mounted on opposite sides of the crankshaft. The left hand bank is provided for rolling one set of pins and the right hand bank is provided for rolling the set of pins which neighbor the first set of pins. Accordingly with this invention, there is sufficient room to simultaneously roll all of the fillets and as well as the main shaft bearings 210, 212, 214, 215 if desired, in one machine. As best illustrated in FIG. 8, fillet rolling jaws of jaw units 216, 218, 220, 222 which are similar to those previously described, have tooling like that of FIG. 2 that can be employed for rolling the fillets of the main bearings while the pin fillets are being rolled.

While a preferred embodiment of the invention has been shown and described, other embodiments will now become apparent to those skilled in the art. Accordingly, this invention is not to be limited to that which is shown and described but by the following claims.

What is claimed is:

1. A machine for fatigue strengthening a ductile iron crankshaft for an internal combustion engine that has a centralized axis of rotation and a plurality of cylindrical crank pin journals parallel to the axis of rotation with adjacent fillets and with facing fillets by simultaneously mechanically working the substrate of the adjacent and of the facing fillets of said cylindrical crank pin journals, said machine comprising first and second support means, first and second swing arm means, first and second pivot means operatively connecting said first and second swing arm means respectively to said first and second support means, first and second clamping jaw sets extending laterally toward said crankshaft respectively from points on opposite sides of said crankshaft, each said jaw set having a lower jaw and an upper jaw and pivot means for pivotally connecting said lower jaw and said upper jaw to one another, additional pivot means for connecting said each said upper jaw to said swing arm means associated therewith, each of said jaw sets having tool holding means for holding tools for simultaneously working the substrate of the adjacent and of the facing fillets of said crank pin journal by the rotation of said crankshaft about said axis of rotation causing each of said swing arm means supporting said associated jaw set to swing on said first and second pivot means and oscillate in an arc while the jaws of each of said jaw sets orbit about said associated crank pin journal.

2. A machine for fatigue strengthening a ductile iron crankshaft for an internal combustion engine by simultaneously mechanically working the substrate of adjacent and facing annular fillets of cylindrical crank pin journals of the crankshaft having central axes offset from one another and parallel to the rotational axis of said crankshaft comprising support means, first and second swing arm means, pivot means operatively connecting said swing arm means to said support means, first and second clamping jaw sets disposed respectively on opposite sides of said crankshaft, each jaw set having a lower jaw and an upper jaw and pivot means for pivotally connecting said lower jaw and said upper jaw to one another, additional pivot means for connecting said upper jaw of said first jaw set to said first swing arm means, and for connecting said upper jaw of said second jaw set to said second swing arm means, each of said jaw sets having a pair of jaws defining tool holding means, tooling means operatively mounted in said tool holding means for simultaneously working the substrate of adjacent and facing fillets of said crank pin journals by the powered rotation of said crank about said axis of rotation causing each of said swing arm means to move in an arc and the jaws of each of said jaw sets to orbit about said axis while said tooling means circumscribes said pin journals and fully works said substrate of said annular fillets.

3. A machine for simultaneously working the fillets of pairs of directly connected axially and arcuately spaced annular journals of an elongated crankshaft having an axis of rotation and in response to the powered rotation of said crankshaft comprising:

a plurality of pairs of floating tool holders and being formed from upper and lower lever arms, a first support means for supporting a first of said pairs on one side of said crankshaft and second support means for operatively supporting a second of said pairs on the opposite side of said crankshaft, first and second actuator means for moving said tool holders toward and away from one another, each of said lever arms having discrete forward and terminal end portions, pivot means pivotally connecting an upper lever arm to a lower lever arm of each pair of lever arms between the forward and terminal end portions thereof, said upper and lower lever arms of each pair of lever arms having force receiving ends near the terminal end portions thereof and force apply jaws at forward ends thereof;

opening and closing force generating means operatively connected to said terminal end portions of each of said pairs of lever arms and operable to open and close said force apply jaws, and tool means connected to said force apply jaws to work the fillets of said workpiece as tool holders are moved to points adjacent to one another and into operative engagement with adjacent fillets when said workpiece is rotatably driven about said central axis and said force generating means is operated to effect the application of a work load to said tool means through said closing force generating means applied to said jaw means.

4. The machine of claim 3, wherein said machine deep rolls fillets of crank pins of a crankshaft for an internal combustion engine and wherein said crank pins are integral with one another and have centers that are arcuately offset from one another and are radially spaced from the rotational axis of said crankshaft.

5. The machine defined in claim 3 and wherein said support means extends above said crankshaft, and swing arm means pivotally secured to said support means and pivot means connecting each pair of said lever arms to one another so that said pairs of lever arms can float as said workpiece is powered around said rotational axis.

6. A method of simultaneously rolling the fillets of a plurality of pairs of juxta-positioned pin journals of an elongated internal combustion engine crankshaft having an axis of rotation comprising the steps of:

a. mounting one end of the crankshaft in the headstock of a motor driven crankshaft rotating machine and the other end in a support in the machine so that the crankshaft can be driven by said machine about its axis of rotation, b. positioning left and right side fillet rolling units at first stations on the left and right sides respectively of said crankshaft, each said units having a plurality of pairs of elongated and pivotally connected lever arms, each pair of lever arms having fillet rolling tooling operatively mounted therein, each pair of lever arms extending generally transversely to said axis of rotation of said crankshaft and said crankshaft, loading said crankshaft into said crankshaft rotating machine, c. moving said left and right side fillet rolling units from said first stations toward said crankshaft to second stations in which the fillet tooling carried of the end of said lever arms contacts said fillets of said pairs of journals, d. applying a load to said pin journals through said lever arms and said tooling, e. powering said machine to rotate said crankshaft so that said tooling rolls and simultaneously works the fillets of said plurality of pairs of pin journals, f. opening said lever arms and removing said rolled crankshaft from said machine.

7. A method of simultaneously rolling the fillets of a plurality of journals of an elongated crankshaft having an axis of rotation for an internal combustion engine including a plurality of pairs of juxta-positioned crank pin journals having fillets comprising the steps of:

a. providing a drive motor for turning the crankshaft about its axis of rotation, b. providing left and right side fillet rolling mechanisms each of which has a plurality of elongated fillet rolling arm members on opposite sides of said axis of rotation so that the rolling arms of said mechanism generally extend toward one another and toward the axis of rotation, c. moving said left and right side fillet rolling mechanisms apart from one another so that a crankshaft can be loaded into said drive tool, d. loading a crankshaft into said drive tool so that said tool can be rotatably driven, e. moving said fillet rolling mechanisms to a rolling position to roll said fillets in which said fillets are operatively contacted by said rolling mechanisms, and f. rolling the fillets in response to the turning of said crankshaft by said drive motor.

8. A method of deep rolling the fillets of pairs of overlapping and arcuately offset cylindrical crank pins of a crankshaft for an internal combustion engine, said crank pins having pairs of inboard fillets that arcuately overlap one another and with a fence therebetween and having pairs of outboard fillets comprising the steps of:

deep pressure rolling the inboard fillets of each of said crank pins with the arcuate overlap of the inboard crank pin fillets rolled at a pressure higher than the remaining arcuate sections thereof to optimize integrity of said fence, and deep pressure rolling the outboard fillets of the crank pin journals with a substantially constant pressure to fully strengthen said outboard fillets and said crankshaft.

9. A machine for rolling the annular fillets of pairs of cylindrical crank pins of an internal combustion engine crankshaft arcuately offset, said pins of each pair being directly connected to one another with a first of said pins of each pair providing a journal for an associated piston connecting rod and with a second of said pins of each pair providing a journal for another associated piston connecting rod, said machine comprising a crankshaft holding and turning device for releasably holding and selectively turning said crankshaft about a centralized axis of rotation, a first set of fillet rolling tools operatively positioned on one side of said crankshaft and the central axis thereof for rolling said fillets of said first crank pins of each said pair, a second set of fillet rolling tools operatively positioned on another side of said crankshaft and the central axis thereof for rolling said fillets of said second crank pins of each said pair, and mechanisms for moving said first and second sets of fillet rolling tools between (1) an open position and away from said crankshaft holding and turning device so that a crankshaft with rolled pin fillets can be removed from said crankshaft holding and turning device and a crankshaft with unrolled pin fillets can be loaded into said crankshaft holding and turning device, and (2) a closed position in which said fillet rolling tools of both of said sets operatively engage said fillets of said pairs of pins at the same time so they can be rolled and strengthened.

* * * * *